US008721369B1

(12) United States Patent
Hsiao

(10) Patent No.: US 8,721,369 B1
(45) Date of Patent: May 13, 2014

(54) MULTI-CONNECTOR POWER OR POWER AND SIGNAL TRANSMISSION CABLE

(71) Applicant: Chien-Tang Hsiao, New Taipei (TW)

(72) Inventor: Chien-Tang Hsiao, New Taipei (TW)

( * ) Notice: Subject to any disclaimer, the term of this patent is extended or adjusted under 35 U.S.C. 154(b) by 19 days.

(21) Appl. No.: 13/706,176

(22) Filed: Dec. 5, 2012

(51) Int. Cl.
*H01R 25/00* (2006.01)
*H01R 27/02* (2006.01)
*H01R 31/00* (2006.01)

(52) U.S. Cl.
USPC ..... 439/638

(58) Field of Classification Search
CPC ..... H01R 31/06; H01R 23/025; H01R 33/92
USPC ..... 439/221, 638, 639, 640
See application file for complete search history.

(56) References Cited

U.S. PATENT DOCUMENTS

| | | | | |
|---|---|---|---|---|
| 6,464,519 | B1 * | 10/2002 | Hawks | 439/172 |
| 7,255,567 | B1 * | 8/2007 | Liao | 439/11 |
| 7,473,141 | B2 * | 1/2009 | Liao | 439/638 |
| 8,298,003 | B2 * | 10/2012 | Wu | 439/501 |
| 8,512,064 | B1 * | 8/2013 | Kwankijpongsa et al. | 439/374 |
| 8,517,772 | B2 * | 8/2013 | Wu | 439/638 |
| 8,550,856 | B2 * | 10/2013 | Lin | 439/638 |

* cited by examiner

*Primary Examiner* — Hae Moon Hyeon

(57) ABSTRACT

A multi-connector power or power and signal transmission cable includes a connection cable, a first connection head connected to one end of the connection cable and at least one connector to mate with the first connection head. The first connection head includes a first plug at a front end thereof. The connector includes a second plug and a socket at front and rear ends thereof. The first plug is detachably connected to the socket of the connector. The connector includes a connection arm thereon. The connection arm has a protruding block at a distal end thereof. The first connection head has a pivot hole for connection of a rotation disc. The rotation disc includes a rotation axle and a receiving hole on the top end of the rotation axle. The connection arm of the connector is detachably connected to the receiving hole of the first connection head.

3 Claims, 4 Drawing Sheets

MULTI-CONNECTOR POWER OR POWER AND SIGNAL TRANSMISSION CABLE

BACKGROUND OF THE INVENTION

1. Field of the Invention

The present invention relates to an electronic product, and more particularly, to a multi-connector power or power and signal transmission cable.

2. Description of the Prior Art

These days, cell phones are widely used and become a necessary appliance for people. There are various cell phones on the market. For most cell phones on the market, cell phones use a standard transmission cable. But, some cell phones use a special interface so a special transmission cable is required. This special transmission cable cannot be applied to a different cell phone for data transmission, so it is necessary to prepare for an additional transmission cable. In order to solve this problem, there is a carry-on dual-connector transmission cable on the market. This transmission cable comprises a first connection head and a connector respectively corresponding to the interfaces of different cell phones. The connector is connected to the first connection head. This single transmission cable achieves multiple purposes. However, this transmission cable has some shortcomings. When the first connection head is used, the connector must be disengaged from the first connection head and placed at another position. Sometimes, the connector is lost to cause great inconvenience for the user. Accordingly, the present invention intends to provide a multi-connector power or power and signal transmission cable for improving the shortcomings mentioned above.

SUMMARY OF THE INVENTION

The primary object of the present invention is to provide a multi-connector power or power and signal transmission cable. At least one connector is detachably connected to a first connection head by cooperation of a connection arm and a receiving hole. The connector won't be lost easily. The first connection head may be provided with several connectors to achieve multiple connection functions for convenient use.

In order to achieve the aforesaid object, the multi-connector power or power and signal transmission cable of the present invention comprises a connection cable, a first connection head connected to one end of the connection cable and at least one connector to mate with the first connection head. The first connection head comprises a first plug at a front end thereof. The connector comprises a second plug at a front end thereof and a socket at a rear end thereof. The first plug is detachably connected to the socket of the connector. Wherein, the connector comprises a connection arm thereon. The connection arm has a protruding block at a distal end thereof. The first connection head has a pivot hole thereon for connection of a rotation disc. The rotation disc comprises a rotation axle and a receiving hole on the top end of the rotation axle. The connection arm of the connector is detachably connected to the receiving hole of the first connection head. The protruding block of the connection arm extends out of the receiving hole to prevent the connector from disengagement.

Preferably, the protruding block has a guide surface thereon to guide the connection arm to slide in the receiving hole.

Preferably, the connection arm is integrally formed with the connector.

Compared to the prior art, the advantage and effect of the present invention is that at least one connector is detachably connected to the first connection head by cooperation of the connection arm and the receiving hole to change the connector for power or signal transmission. The connector can be rotated about the rotation axle without limitation. By the receiving hole of the rotation axle and the turning of the connection arm, the connector can be returned. The multi-connector power or signal transmission cable of the present invention has a simple configuration and can be used conveniently and can prevent the connector from losing.

DETAILED DESCRIPTION OF THE PREFERRED EMBODIMENTS

Embodiments of the present invention will now be described, by way of example only, with reference to the accompanying drawings.

Figure 1:
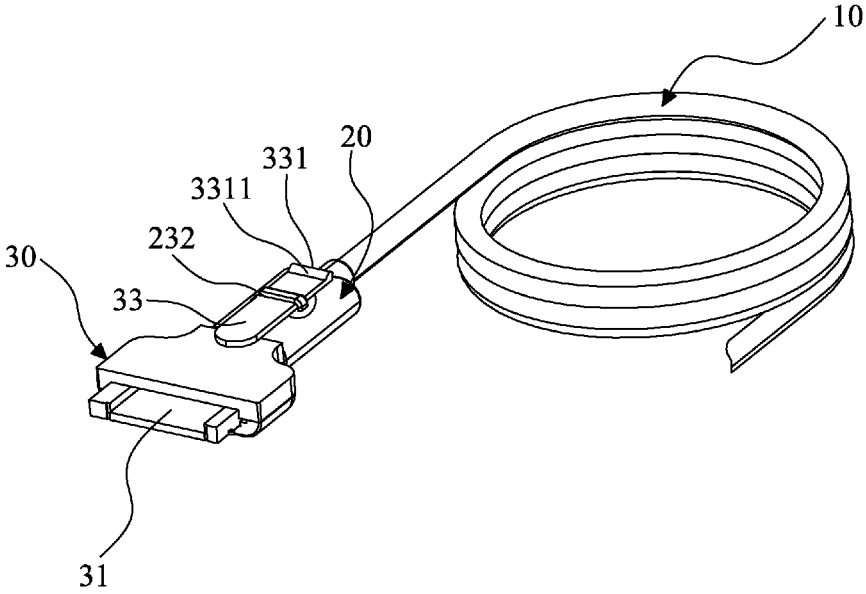
FIG. 1 is a schematic view showing the first connection head connected to the connector according to a preferred embodiment of the present invention.
Figure 2:
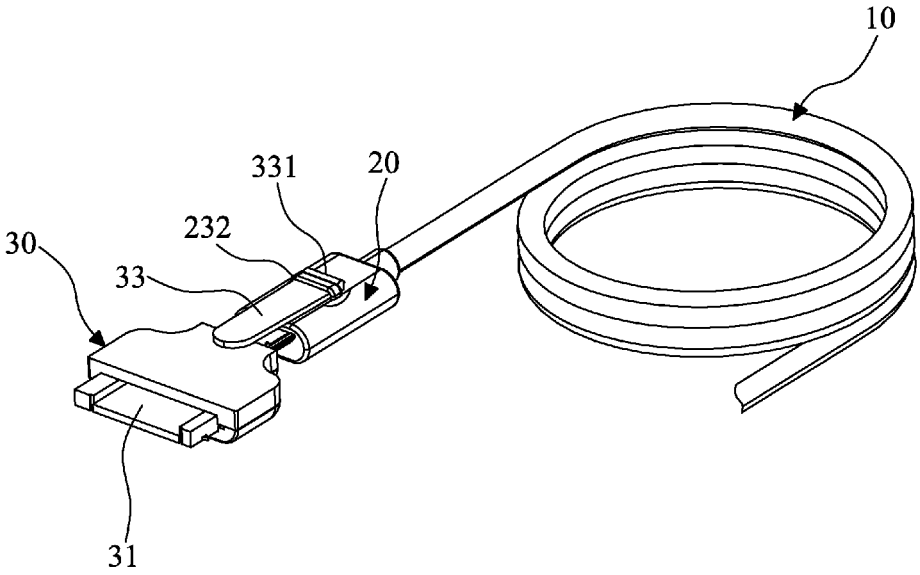
FIG. 2 is a schematic view showing the first connection head disconnected from the connector according to the preferred embodiment of the present invention.
Figure 3:
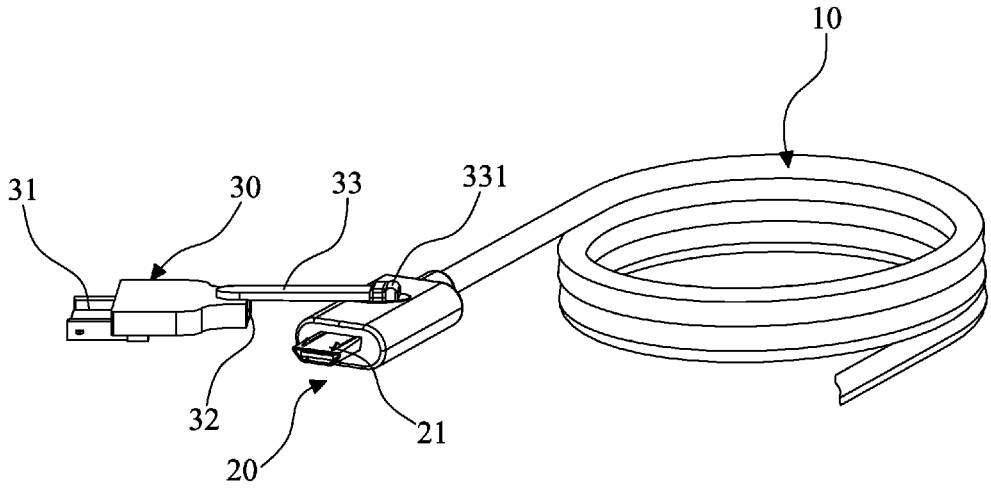
FIG. 3 is a schematic view showing the connector turned to locate beside the first connection head according to the preferred embodiment of the present invention.
Figure 4:
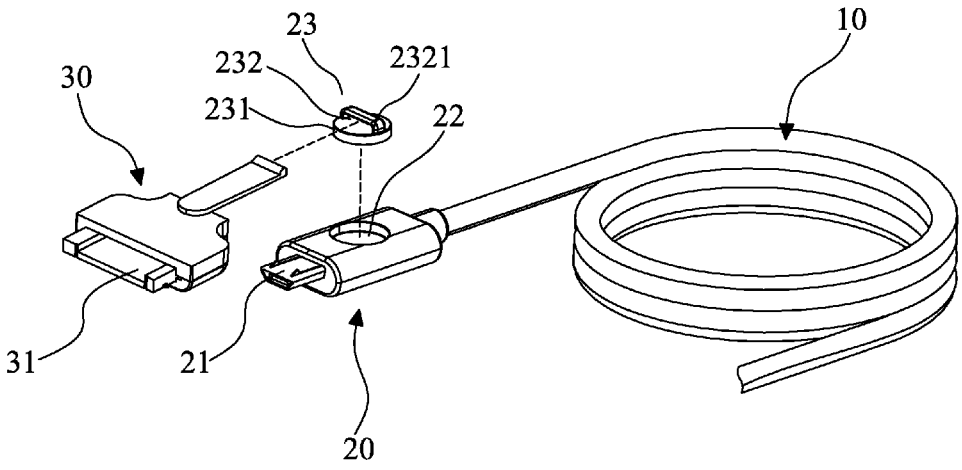
FIG. 4 is an exploded view according to the preferred embodiment of the present invention.

As shown in FIG. 1 to FIG. 4, the multi-connector power or power and signal transmission cable according to a first embodiment of the present invention comprises a connection cable 10, a first connection head 20 and a connector 30.

The first connection head 20 is connected to one end of the connection cable 10. The first connection head 20 comprises a first plug 21 at a front end thereof. The upper surface of the first connection head 20 has a pivot hole 22 for connection of a rotation disc 23. The rotation disc 23 comprises a rotation axle 231 and a receiving hole 232 on the top end of the rotation axle 231. The receiving hole 232 is integrally connected with the top end of the rotation axle 231 and formed by a frame 2321 and the upper surface of the rotation axle 231.

The connector 30 comprises a second plug 31 at a front end thereof and a socket 32 at a rear end thereof. The socket 32 is to mate with the first plug 21 of the first connection head 20. The socket 32 is detachably connected to the first plug 21. The connector 30 is integrally formed with a connection arm 33. The connection arm 33 has a protruding block 331 at a distal end thereof. The protruding block 331 has a guide surface 3311 thereon to guide the connection arm 33 to slide in the receiving hole 232. The connection arm 33 is detachably connected to the receiving hole 232 of the first connection head 20. The protruding block 331 of the connection arm 33 extends out of the receiving hole 232 to prevent the connector from disengagement.

According to a second embodiment of the present invention, the connector 30 connected to the first connection head 20 can be replaced with a corresponding connector 30 to achieve the corresponding connection function.

According to a third embodiment of the present invention, the first connection head 20 can be provided with a plurality of rotation discs 23. Each rotation disc 23 is connected with a connector 30, such that the user can elect a desired connector 30 to mate with the first connection head 20 to achieve different connection functions. The other connectors 30 can be turned to locate beside the first connection head 20 so as to provide enough space for the desired connector 30 to mate with the first connection head 20.

When the connector 30 is required, the first plug 21 of the first connection head 20 is plugged to the socket 32 at the rear end of the connector 30. When the first connection head 20 is required, the first plug 21 of the first connection head 20 is unplugged from the socket 32 of the connector 30 and the connector 30 is turned to locate beside the first connection head 20. When it is necessary to replace with another connector 30, the connection arm 33 of the connector 30 is disengaged from the first connection head 20 to replace with the desired connector 30.

The feature of the present invention is that at least one connector is detachably connected to the first connection head by cooperation of the connection arm and the receiving hole to change the connector for power or signal transmission. The connector can be rotated about the rotation axle without limitation. By the receiving hole of the rotation axle and the turning of the connection arm, the connector can be returned. The multi-connector power or signal transmission cable of the present invention has a simple configuration and can be used conveniently and can prevent the connector from losing.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multi-connector power or power and signal transmission cable, comprising a connection cable, a first connection head connected to one end of the connection cable and at least one connector to mate with the first connection head, the first connection head comprising a first plug at a front end thereof, the connector comprising a second plug at a front end thereof and a socket at a rear end thereof, the first plug being detachably connected to the socket of the connector, characterized by: the connector comprising a connection arm thereon, the connection arm having a protruding block at a distal end thereof, the first connection head having a pivot hole thereon for connection of a rotation disc, the rotation disc comprising a rotation axle and a receiving hole on a top end of the rotation axle, the connection arm of the connector being detachably connected to the receiving hole of the first connection head, the protruding block of the connection arm extending out of the receiving hole to prevent the connector from disengagement.

2. The multi-connector power or power and signal transmission cable as claimed in claim 1, wherein the protruding block has a guide surface thereon to guide the connection arm to slide in the receiving hole.

3. The multi-connector power or power and signal transmission cable as claimed in claim 1, wherein the connection arm is integrally formed with the connector.

* * * * *